US010047636B2

(12) United States Patent
Akturk et al.

(10) Patent No.: US 10,047,636 B2
(45) Date of Patent: Aug. 14, 2018

(54) GAS TURBINE DIFFUSER OUTER DIAMETER AND INNER DIAMETER WALL STRIPS FOR TURBINE EXHAUST MANIFOLD PRESSURE OSCILLATION REDUCTION

(71) Applicant: Siemens Energy, Inc., Orlando, FL (US)

(72) Inventors: Ali Akturk, Oviedo, FL (US); Jose L. Rodriguez, Lake Mary, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 496 days.

(21) Appl. No.: 14/725,495

(22) Filed: May 29, 2015

(65) Prior Publication Data

US 2016/0348537 A1 Dec. 1, 2016

(51) Int. Cl.

| | |
|---|---|
| ***F01D 25/30*** | (2006.01) |
| ***F01D 25/16*** | (2006.01) |
| ***F01D 5/14*** | (2006.01) |

(52) U.S. Cl.

CPC ..... *F01D 25/30* (2013.01); *F01D 5/143* (2013.01); *F01D 25/162* (2013.01); *F05D 2250/11* (2013.01); *F05D 2250/13* (2013.01); *F05D 2250/141* (2013.01); *F05D 2250/23* (2013.01); *F05D 2250/231* (2013.01); *F05D 2260/964* (2013.01)

(58) Field of Classification Search

CPC ..... F01D 25/30; F01D 5/143; F01D 25/162; F01D 25/16; F01D 25/28; F01D 25/305; F05D 2260/964; F05D 2250/11; F05D 2250/13; F05D 2250/141; F05D 2250/23; F05D 2250/231; F05D 2240/14

See application file for complete search history.

(56) References Cited

U.S. PATENT DOCUMENTS

| | | | | |
|---|---|---|---|---|
| 2,650,752 | A * | 9/1953 | Hoadley | B64C 23/06 138/37 |
| 4,023,350 | A * | 5/1977 | Hovan | F01D 5/145 415/208.2 |
| 5,692,709 | A * | 12/1997 | Mihora | B64C 23/04 244/204 |
| 2012/0325325 | A1* | 12/2012 | Quackenbush | F02C 7/04 137/1 |
| 2013/0111906 | A1* | 5/2013 | Bouchard | F02K 1/827 60/694 |
| 2013/0170969 | A1* | 7/2013 | Subramaniyan | F01D 5/146 415/191 |
| 2014/0041357 | A1* | 2/2014 | Malandra | F01D 25/30 60/39.5 |

* cited by examiner

*Primary Examiner* — Logan Kraft
*Assistant Examiner* — Eric Zamora Alvarez

(57) ABSTRACT

An arrangement to minimize vibrations in a gas turbine exhaust diffuser is provided. The arrangement includes a projection coupled to an inner cylindrical surface or the outer cylindrical surface of a fluid flow path of the gas turbine exhaust diffuser. The projection minimizes pressure oscillations in the gas turbine exhaust diffuser such that an unsteadiness of the fluid flow surrounding the second tangential strut is reduced. A method to minimize pressure oscillations in a gas turbine diffuser is also provided.

13 Claims, 3 Drawing Sheets

GAS TURBINE DIFFUSER OUTER DIAMETER AND INNER DIAMETER WALL STRIPS FOR TURBINE EXHAUST MANIFOLD PRESSURE OSCILLATION REDUCTION

BACKGROUND

1. Field

The present application relates to gas turbines, and more particularly to an arrangement and method to minimize flow induced vibration in a gas turbine exhaust diffuser.

2. Description of the Related Art

The turbine exhaust cylinder and the turbine exhaust manifold are coaxial gas turbine casing components connected together establishing a fluid flow path for the gas turbine exhaust diffuser. The fluid flow path includes an inner flow path and an outer flow path defined by an inner diameter delimiting an outer cylindrical surface of the inner flow path and an outer diameter delimiting an inner cylindrical surface of the outer flow path, respectively. Tangential struts are arranged within the fluid flow path and serve several purposes such as supporting the flow path and provide a pathway for lubrication piping. Turbine exhaust cylinder and turbine exhaust manifold tangential struts are arranged in circumferential rows and extend between the outer cylindrical surface and the inner cylindrical surface. For the last row of turbine exhaust cylinder tangential struts in the direction of flow, every other turbine exhaust cylinder tangential strut may be aligned, axially, with a turbine exhaust manifold strut. As an example, there may be six turbine exhaust cylinder tangential struts arranged in a circumferential row and three turbine exhaust manifold tangential struts aligned axially with every other turbine exhaust cylinder strut.

At certain conditions, unsteadiness of the exhaust flow around the tangential struts can cause vibrations of the inner and outer diameter of the turbine exhaust cylinder and the turbine exhaust manifold. The strut flow unsteadiness may cause large oscillations in flow path pressures that force the flowpath structure to vibrate or even resonate strongly. These vibrations are a potential contributor to damage occurring on the flow path of the turbine exhaust manifold and the turbine exhaust cylinder. This damage to the diffuser flow path may require replacement or repair.

SUMMARY

Briefly described, aspects of the present disclosure relates to an arrangement to minimize vibrations in a gas turbine exhaust diffuser and a method to minimize pressure oscillations in a gas turbine exhaust diffuser.

A first aspect provides an arrangement to minimize vibrations in a gas turbine exhaust diffuser. The arrangement includes a gas turbine exhaust diffuser. The gas turbine diffuser includes a turbine exhaust manifold connected to a turbine exhaust cylinder establishing a fluid flow path, the fluid flow path bounded radially outward by an outer cylindrical surface and bounded radially inward by an inner cylindrical surface. A first tangential strut is arranged in the turbine exhaust cylinder between the outer cylindrical surface and the inner cylindrical surface. A second tangential strut in the turbine exhaust manifold is disposed downstream from the first tangential strut between the outer cylindrical surface and the inner cylindrical surface. A projection is coupled to the inner cylindrical surface or the outer cylindrical surface and minimizes pressures oscillations in the gas turbine exhaust diffuser such that an unsteadiness of the fluid flow surrounding the second tangential strut is reduced.

A second aspect provides a method to minimize pressure oscillations in a gas turbine exhaust diffuser. The method includes disposing a projection on an outer cylindrical surface or an inner cylindrical surface of a fluid flow path of the gas turbine exhaust diffuser, and coupling the projection to the outer cylindrical surface or the inner cylindrical surface. The fluid flow path is bounded radially outward by an outer cylindrical and bounded radially inward by an inner cylindrical surface. The projection minimizes pressure oscillations in the gas turbine exhaust diffuser such that an unsteadiness of the fluid flow surrounding of the second tangential strut is reduced.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

In order to prevent the tangential strut flow unsteadiness on a turbine exhaust cylinder strut, a turbine exhaust cylinder strut strip may be used on the turbine exhaust cylinder tangential strut. The flow unsteadiness on the turbine exhaust cylinder tangential strut is driven by transonic shock induced oscillations on a side of the turbine exhaust cylinder strut airfoil. This unsteadiness is mitigated using the turbine exhaust cylinder strut strip which reduces the shock wave. However, the turbine exhaust cylinder strut strip causes fluid flow separation from the turbine exhaust cylinder tangential strut downstream. This fluid flow separation known as a 'separation bubble' may negatively interact with the turbine exhaust manifold leading edge flow and may cause pressure oscillations such that the turbine exhaust manifold strut experiences unsteadiness. In order to minimize these pressure oscillations in the gas turbine exhaust diffuser such that an unsteadiness of the turbine exhaust manifold tangential strut is reduced, a projection or a plurality of projections positioned on a surface of the inner diameter or outer diameter is proposed.

Figure 1:
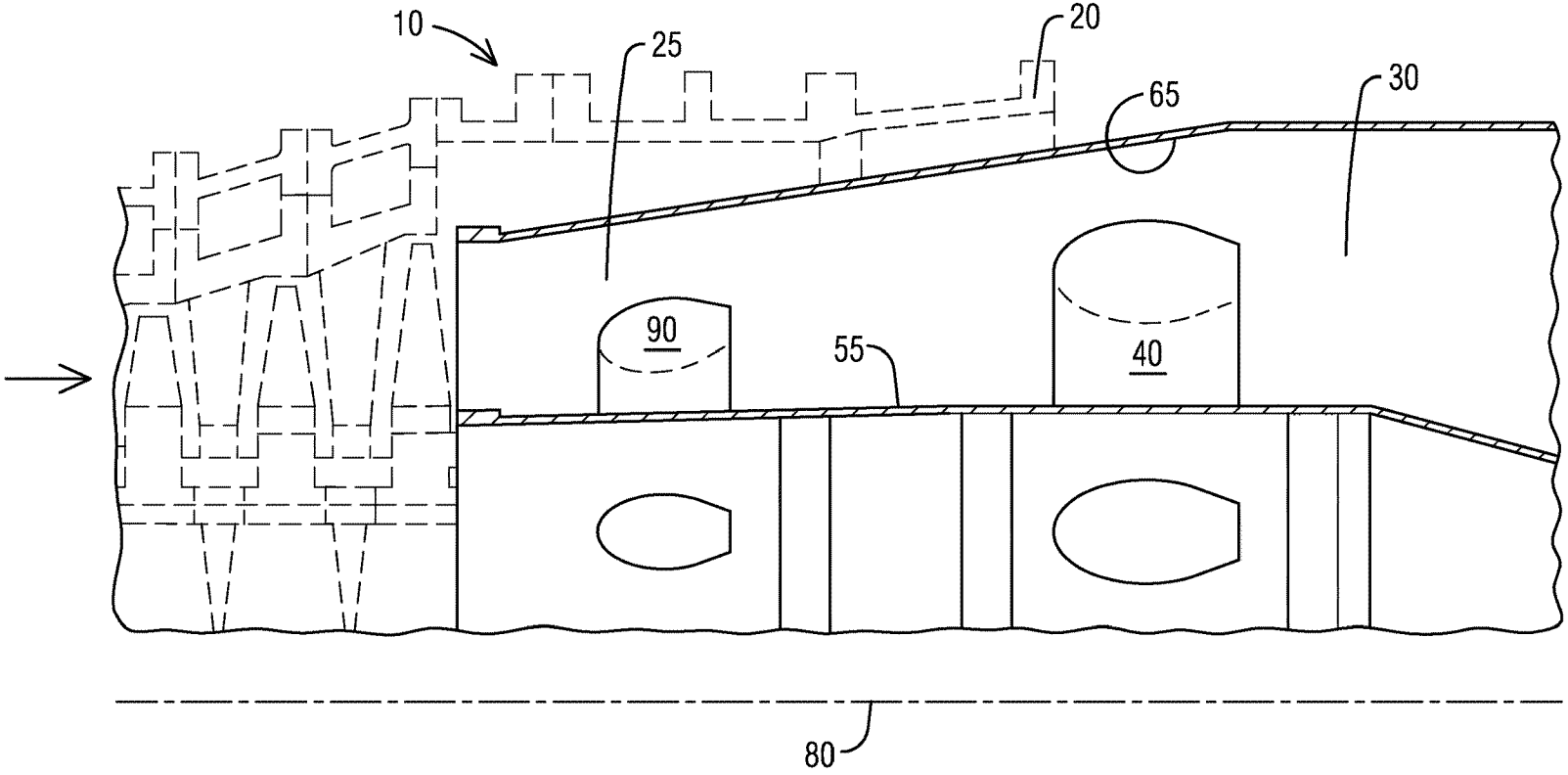
FIG. 1 . . . illustrates a longitudinal view of the gas turbine exhaust diffuser, FIG. 2 . . . illustrates an isometric view of the gas turbine exhaust diffuser including projections on the inner cylindrical surface, FIG. 3 . . . illustrates a cross-section of a projection, and FIG. 4 . . . illustrates cross-sections of possible projections.

FIG. 1 illustrates a longitudinal view of the gas turbine exhaust diffuser (10). The gas turbine exhaust diffuser (10) is disposed in the aft portion of the turbine section of the gas turbine and includes a turbine exhaust cylinder (20) and a turbine exhaust manifold (30). The turbine exhaust manifold (30) is connected downstream from the turbine exhaust cylinder (20) and establishes a fluid flow path (25). The fluid flow path (25) is bounded radially inward by an inner cylindrical surface (55) and radially outward by an outer cylindrical surface (65) with respect to a rotor centerline (80). Tangential struts (40, 90) are hollow tubes that may extend between the inner flow path to the outer flow path. A turbine exhaust cylinder tangential strut (90) is shown within the turbine exhaust cylinder (20) upstream of a turbine exhaust manifold tangential strut (40).

Figure 2:
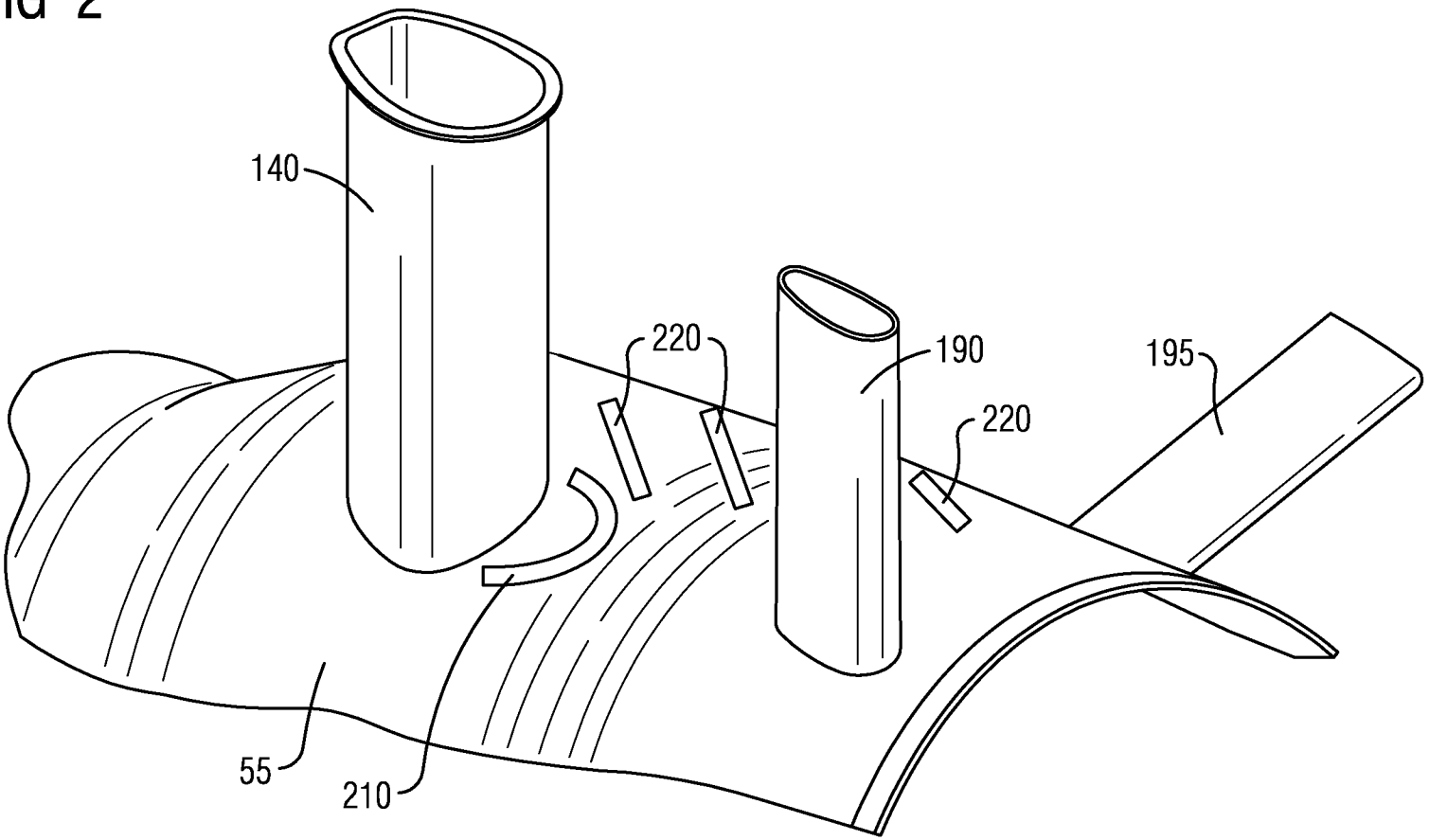

FIG. 2 is an isometric view of the gas turbine exhaust diffuser (10) showing two turbine exhaust cylinder struts (190, 195) and one turbine exhaust manifold strut (140). The turbine exhaust manifold strut (140) is disposed downstream from the turbine exhaust cylinder struts (190, 195) in a flow direction. The turbine exhaust cylinder struts (190, 195) and the turbine manifold struts (140) are shown extending from the inner cylindrical surface (55). The outer cylindrical surface (65) is not shown in this view, however, the struts (140, 190, 195) extend from the inner cylindrical surface (55) to the outer cylindrical surface (65). A first turbine exhaust cylinder strut (190) is aligned axially in a flow direction with a second turbine exhaust manifold strut (140). In this shown embodiment, projections (210, 220) are shown on the inner cylindrical surface (55).

Figure 3:
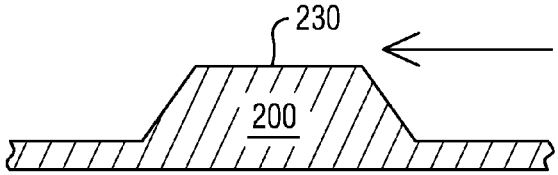
Figure 4:
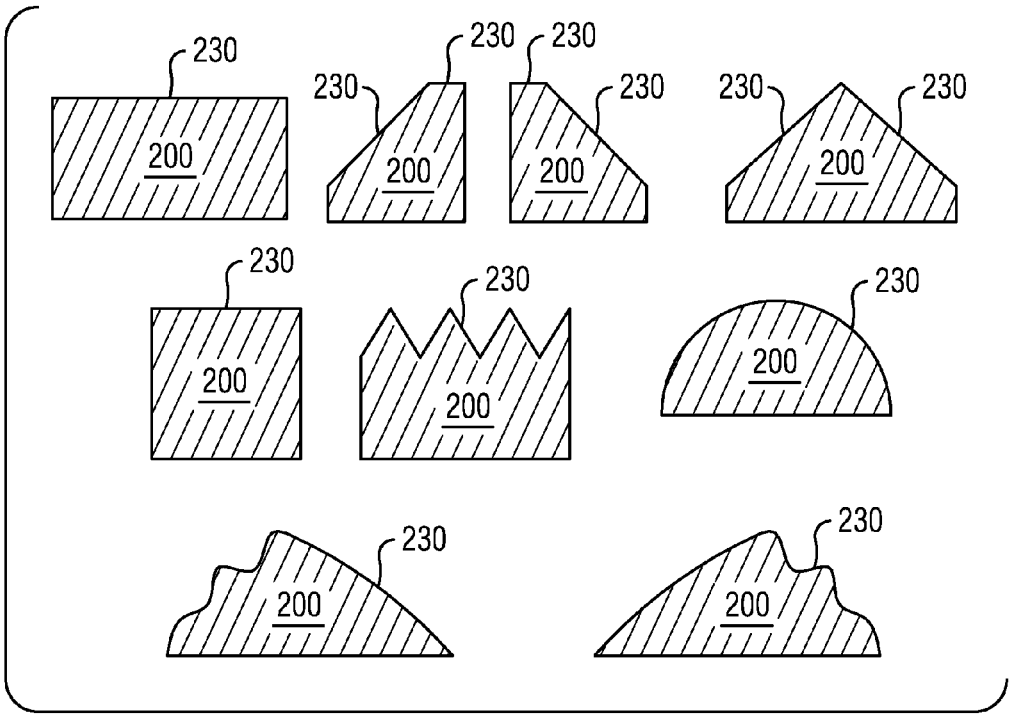

FIG. 3 illustrates one embodiment of a cross section of a projection (200). Other possible cross sections include but are not limited to rectangular, triangular, circular, or combinations thereof. The shown embodiment illustrated includes a ramp like cross section. The surface of the projection (230) exposed to the fluid flow may include a planar surface, an undulating surface, and a jagged surface. Other possible embodiments are shown in FIG. 4. The shape and size of the projection (200) may be determined based on a result of computational fluid dynamics simulations.

As illustrated in the shown embodiment of FIG. 2, projections (200) which may be embodied as wall strips are disposed such that the wall strip (210, 220) minimizes pressure oscillations in the gas turbine exhaust diffuser (10) such that an unsteadiness of the turbine exhaust manifold tangential strut (140) is reduced. In order to reduce the unsteadiness of the turbine exhaust manifold strut (140), the wall strips (210, 220) may be disposed between a leading edge of the turbine exhaust cylinder strut (190, 195) and a trailing edge of the turbine exhaust manifold strut (140).

More specifically, in an embodiment, a wall strip (210) may be disposed on the inner cylindrical surface (55) in front of the leading edge of the turbine exhaust manifold (140) strut in the shape of a horseshoe as shown. The horseshoe shaped wall strip (210) helps to reduce the interaction of a horseshoe vortex at the leading edge of the turbine exhaust manifold (140) and the fluid flow separation from the turbine exhaust cylinder (190, 195) that is axially aligned with the turbine exhaust manifold (140). In another embodiment, a plurality of wall strips (220) are shown disposed on the inner cylindrical surface (55) in an axial direction between the turbine exhaust cylinder tangential struts (190, 195). The fluid flow separation from a turbine exhaust cylinder (195) that is not aligned with the turbine exhaust manifold (140) may be controlled with the wall strips (220).

Accordingly, the placement of the projections (210, 220) in FIG. 2 is exemplary where one skilled in the art would appreciate that the projections (210, 220) may be disposed anywhere between the leading edge of the turbine exhaust cylinder strut (190) and the turbine exhaust manifold (140) strut where it has been determined to mitigate the pressure oscillations. For example, the projections (210, 200) may be disposed based computational fluid dynamics simulations such that the projections (210, 220) are positioned to disrupt an interaction of a flow separation downstream of the turbine exhaust cylinder strut (190, 195) and the leading edge flow of the turbine exhaust manifold strut (140).

The material of the projection (200, 210, 220) may be the same material or essentially the same material as that of the inner or outer cylindrical surface (55, 65). Having the same or essentially the same material as that of the inner or outer cylindrical surface (55, 65) would minimize the differential growth between the projection (200, 210, 220) and the inner or outer cylindrical surface (55, 65) of the gas turbine exhaust diffuser (10). For example, a steel may be used as the material of the projection (200, 210, 220).

In an embodiment, the projection (200, 210, 220) is disposed such that when the fluid flow flows over the projection (200, 210, 220), a specific frequency of the fluid flow is produced. This specific frequency would be different from a surrounding frequency such that the specific frequency would not couple with the surrounding frequency. In essence, a frequency filter would be created in the region of the projection (200, 210, 220).

Referring to FIGS. 1-4, a method to minimize pressure oscillations in a gas turbine exhaust diffuser is also provided. In an embodiment, a projection (200, 210, 220) is disposed on an outer cylindrical surface (65) or an inner cylindrical surface (55) of the flow path of the gas turbine exhaust diffuser. The projection (200, 210, 220) may then be coupled to the outer cylindrical surface (65) or the inner cylindrical surface (55). The coupling may include welding a surface of the projection (200, 210, 220) to the outer cylindrical surface (65) or the inner cylindrical surface (55).

The projection (200, 210, 220) may be disposed between the leading edge of the turbine exhaust cylinder strut (190) and the trailing edge of the turbine exhaust manifold strut (140) with reference to the fluid flow path. Computational fluid dynamic simulations may be used to determine optimal positioning for the projection (200, 210, 220) such that the projection (200, 210, 220) disrupts an interaction of a flow separation downstream of the turbine exhaust cylinder strut and a leading edge flow of a turbine exhaust manifold strut (140).

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. An arrangement to minimize vibrations in a gas turbine exhaust diffuser, comprising:

a gas turbine exhaust diffuser, comprising:

a turbine exhaust manifold connected to a turbine exhaust cylinder establishing a fluid flow path, the fluid flow path bounded radially outward by an outer cylindrical surface and bounded radially inward by an inner cylindrical surface;

a first tangential strut arranged in the turbine exhaust cylinder between the outer cylindrical surface and the inner cylindrical surface; and a second tangential strut in the turbine exhaust manifold downstream from the first tangential strut between the outer cylindrical surface and the inner cylindrical surface; and a projection coupled to the inner cylindrical surface or the outer cylindrical surface, wherein the projection minimizes pressure oscillations in the gas turbine exhaust diffuser such that an unsteadiness of a fluid flow surrounding the second tangential strut is reduced, wherein the projection is a horseshoe shaped wall strip effective to reduce an interaction of a horseshoe vortex at a leading edge of the turbine exhaust manifold, and wherein the projection is located between a trailing edge of the first tangential strut and a leading edge of the downstream second tangential strut with reference to the fluid flow path so that the projection is disposed in front of the leading edge of the second tangential strut.

2. The arrangement as claimed in claim 1, wherein a material of the projection is the same as a material of the inner and outer cylindrical surface.

3. The arrangement as claimed in claim 2, wherein the material of the projection is steel.

4. The arrangement as claimed in claim 1, wherein the projection is disposed such that the projection is positioned to disrupt with an interaction of a flow separation downstream of the first tangential strut and the leading edge flow of the second tangential strut.

5. The arrangement as claimed in claim 1, wherein a shape and a size of the projection is determined based on a result of computational fluid dynamics simulations.

6. The arrangement as claimed in claim 5, wherein a cross sectional shape of the projection is selected from a group consisting of rectangular, triangular, circular, arbitrary and combinations thereof.

7. The arrangement as claimed in claim 1, wherein the projection is designed to produce a specific frequency in the fluid flow such that the specific frequency does not couple with a surrounding frequency of the fluid flow.

8. The arrangement as claimed in claim 1, wherein a surface of the projection is welded to the inner or outer cylindrical surface.

9. The arrangement as claimed in claim 1, wherein a surface opposite of a surface of the projection which is exposed to the fluid flow is planar.

10. The arrangement as claimed in claim 1, wherein a surface opposite of a surface of the projection which is exposed to the fluid flow is wavy.

11. A method to minimize pressure oscillations in a gas turbine exhaust diffuser, comprising:

disposing a projection on an outer cylindrical surface or an inner cylindrical surface of a fluid flow path of the gas turbine exhaust diffuser;

coupling the projection to the outer cylindrical surface or the inner cylindrical surface, wherein the fluid flow path is bounded radially outward by an outer cylindrical surface and bounded radially inward by an inner cylindrical surface, and wherein the projection minimizes pressure oscillations in the gas turbine exhaust diffuser such that an unsteadiness of the fluid flow surrounding a second tangential strut is reduced, wherein the second tangential strut is disposed downstream from a first tangential strut, both the first tangential strut and the second tangential strut extending between the outer cylindrical surface and the inner cylindrical surface, and wherein the disposing includes locating the projection between a trailing edge of the first tangential strut and a leading edge of the second tangential strut with reference to the fluid flow path, and wherein the projection is a horseshoe shaped wall strip effective to reduce an interaction of a horseshoe vortex at a leading edge of a turbine exhaust manifold.

12. The method as claimed in claim 11, wherein the coupling includes welding a surface of the projection to the outer cylindrical surface or the inner cylindrical surface.

13. The method as claimed in claim 11, wherein the disposing projection is based on a result of computational fluid dynamics simulations such that the projection is positioned to interfere with an interaction of a flow separation downstream of the first tangential strut and a leading edge flow of the second tangential strut.

* * * * *